US007549179B1

(12) United States Patent
Saied

(10) Patent No.: US 7,549,179 B1
(45) Date of Patent: Jun. 23, 2009

(54) SELF-DONNING SURGICAL GOWN

(76) Inventor: Amgad Samuel Saied, 3100 Riverside Dr., #256, Los Angeles, CA (US) 90027

( * ) Notice: Subject to any disclaimer, the term of this patent is extended or adjusted under 35 U.S.C. 154(b) by 0 days.

(21) Appl. No.: 12/070,121

(22) Filed: Feb. 15, 2008

(51) Int. Cl.
*A41D 13/12* (2006.01)

(52) U.S. Cl. ..... 2/51; 2/114

(58) Field of Classification Search ..... 2/51, 2/114, 456, 457, 459, 461–463, 465, 44–46, 2/48, 52, 69, 83, 85, 93, 94, 101, 92, 105, 2/108, 901, 247; D2/720, 724, 739, 839, D2/863, 864, 860
See application file for complete search history.

(56) References Cited

U.S. PATENT DOCUMENTS

| | | | | | |
|---|---|---|---|---|---|
| 2,279,761 | A | * | 4/1942 | Schatten | 2/93 |
| 2,542,300 | A | * | 2/1951 | Bagnato | 2/93 |
| 3,045,815 | A | * | 7/1962 | Abildgaard | 2/114 |
| 3,077,604 | A | * | 2/1963 | Colangelo | 2/93 |
| 3,359,569 | A | * | 12/1967 | Rotanz et al. | 2/114 |
| 3,721,999 | A | * | 3/1973 | Goya et al. | 2/114 |
| 3,824,625 | A | | 7/1974 | Green | |
| 3,843,971 | A | | 10/1974 | Delanty et al. | |
| 3,977,025 | A | | 8/1976 | Horan | |
| 4,171,542 | A | * | 10/1979 | Cox et al. | 2/51 |
| 4,384,369 | A | * | 5/1983 | Prince | 2/93 |
| 4,384,370 | A | | 5/1983 | Singer | |
| 4,558,468 | A | | 12/1985 | Landry et al. | |
| 4,644,589 | A | | 2/1987 | Pettis | |
| 4,674,132 | A | | 6/1987 | Stein et al. | |
| D302,354 | S | * | 7/1989 | Harper et al. | D3/226 |
| 5,097,534 | A | * | 3/1992 | Viemeister et al. | 2/114 |
| 5,247,707 | A | * | 9/1993 | Parker et al. | 2/94 |
| 5,253,642 | A | | 10/1993 | Stackhouse et al. | |
| 5,414,867 | A | | 5/1995 | Bowling et al. | |
| 5,862,525 | A | | 1/1999 | Tankersley et al. | |
| 5,901,376 | A | | 5/1999 | Deirmendjian et al. | |
| 6,049,907 | A | | 4/2000 | Palomo | |
| 6,138,278 | A | | 10/2000 | Taylor et al. | |
| 6,851,125 | B2 | * | 2/2005 | Fujikawa et al. | 2/51 |
| 7,093,304 | B2 | | 8/2006 | Griesbach, III | |
| D530,885 | S | | 10/2006 | Barthel | |
| 2005/0044608 | A1 | | 3/2005 | Ambrose et al. | |
| 2005/0132465 | A1 | | 6/2005 | Kathumbi-Jackson et al. | |

* cited by examiner

*Primary Examiner*—Amy B Vanatta
(74) *Attorney, Agent, or Firm*—Cislo & Thomas, LLP

(57) ABSTRACT

A self-donning surgical gown comprising a plurality of pockets positioned strategically along the shoulders and back to allow the user to insert his hands into the shoulder and waist pockets to secure the surgical gown to his shoulders and back, respectively, without exposing his hands and arms to the non-sterile environment outside the traditional sterile field, thereby effectively increasing the sterile field and allowing the user to self-don a surgical gown. The pockets and/or the back flaps of the surgical gown may comprise fasteners, such as adhesives, hook-and-loop fasteners, ties, magnets, buttons or the like to fasten the self-donning surgical gown to itself or the a garment worn by the user.

20 Claims, 7 Drawing Sheets

SELF-DONNING SURGICAL GOWN

TECHNICAL FIELD

This invention relates to sterile gowns, such as surgical gowns, that can be self-donned and readjusted by the user.

BACKGROUND ART

Surgical gowns are utilized by health care professionals to protect themselves from exposure to fluids and micro-organisms during a surgical procedure. The surgical gown also minimizes contamination of the patient by the health care professional. As such, the health care professionals must keep their hands and arms within a sterile field. The traditional sterile field is the ventral side of the health care professional from approximately the chest or nipple line to the waist. The traditional sterile field also encompasses the area from approximately the elbows to the fingertips.

Currently, surgical gowns are designed with a front portion that covers the front and extends towards the back into back flaps to cover the back. The back flaps traditionally have ties at the neck area and the waist area to secure the surgical gown around the neck and waist. Tying the ties of a traditional gown, however, requires exposure of the hands to an environment outside the sterile field. As such, an assistant is needed to secure a surgical gown around a health care professional in order to keep the health care professional's hands in the sterile field. The assistant is usually unsterilized, which can lead to contamination of parts of the surgical gown and limits the sterile surgical field. Such contamination and limitations increase the patient's risk of surgical infection.

To eliminate the use of an assistant, self-donning gowns have been designed to bring the ties inside the traditional sterile field. In other words, to bring the fastening mechanism to the front. This, however, results in complicated tie structures that do not facilitate readjustment of the gown. In addition, having the fastening mechanisms in the front that could potentially catch instruments and may interfere with the surgical procedure.

Thus, a self-donning surgical gown is needed that is easily donned and easily readjusted and will not interfere with surgical procedures.

DISCLOSURE OF INVENTION

The present invention is directed to a self-donning surgical gown, comprising a front portion continuous with a first back flap and a second back flap, wherein the front portion has an interior side and an exterior side; a first sleeve between the front portion and the first back flap; a second sleeve between the front portion and the second back flap; a first shoulder pocket extending from the front portion adjacent to the first sleeve to the first back flap superior to the first sleeve; a second shoulder pocket extending from the front portion adjacent to the second sleeve to the second back flap superior to the second sleeve; a first waist pocket extending from the front portion to the first back flap inferior to the first arm sleeve; and a second waist pocket extending from the front portion to the second back flap inferior to the second arm sleeve. The self-donning surgical gown may further comprise fasteners on the back flaps at the shoulders and the lower back to attach the gown to the user or to itself.

MODES FOR CARRYING OUT THE INVENTION

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Surgeons, nurses, and other health care professionals must maintain a sterile surgical environment during a surgical procedure. This includes keeping their arms within the traditional sterile field. The traditional sterile field is generally the ventral area from approximately the chest or nipples down to the waist, including the area from approximately the elbows to the fingertips. The traditional sterile field prevents health care professionals from donning their own surgical gowns while maintaining sterility of their hands and arms and parts of their surgical gown. The self-donning surgical gown of the present invention, however, effectively increases and expands the traditional sterile field thereby allowing users to don their own surgical gowns without contaminating their hands and arms or parts of their surgical gown. In addition, by increasing the effective sterile field, the users are able to readjust their surgical gowns without contaminating their hands and arms or any part of the gown. One objective is to be able to reach the hands toward the shoulder or the scapula while keeping the rest of the arm close to the body, and within the traditional sterile field, so as not to brush up against areas outside the traditional sterile field, such as the neck, head, face and hair.

Figure 1:
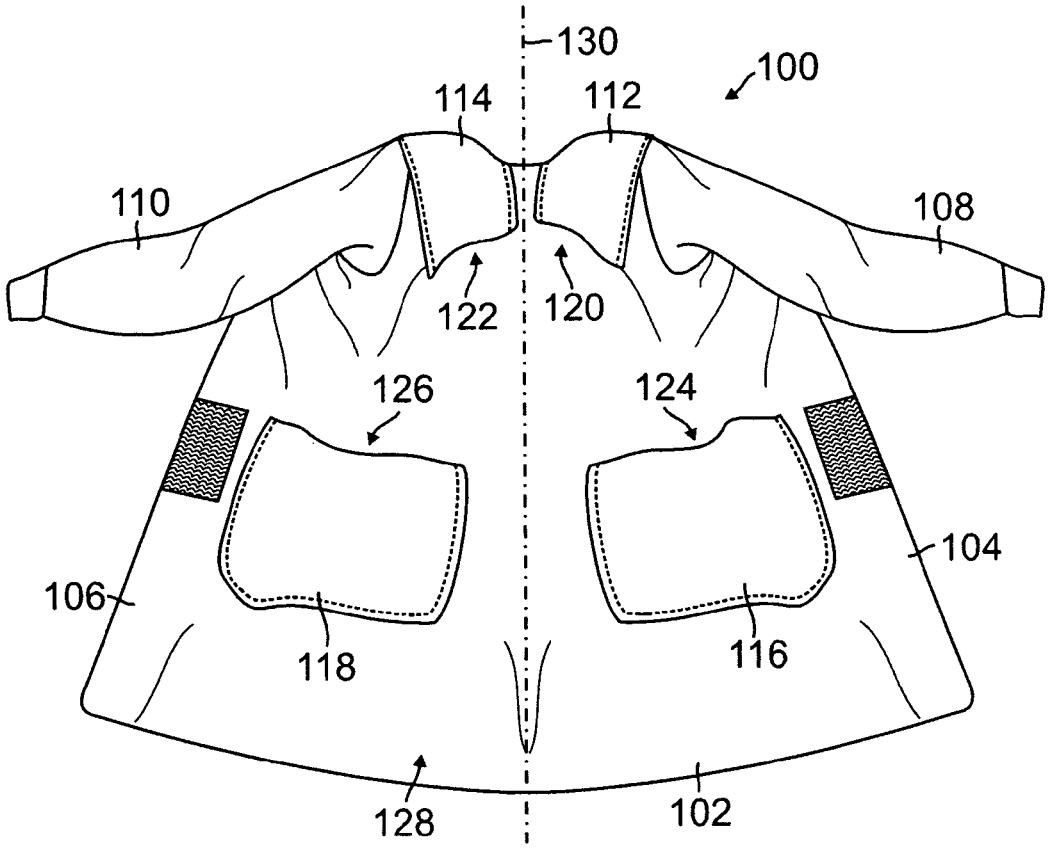
FIG. 1 is a front view of an embodiment of the current invention laid out.
Figure 2:
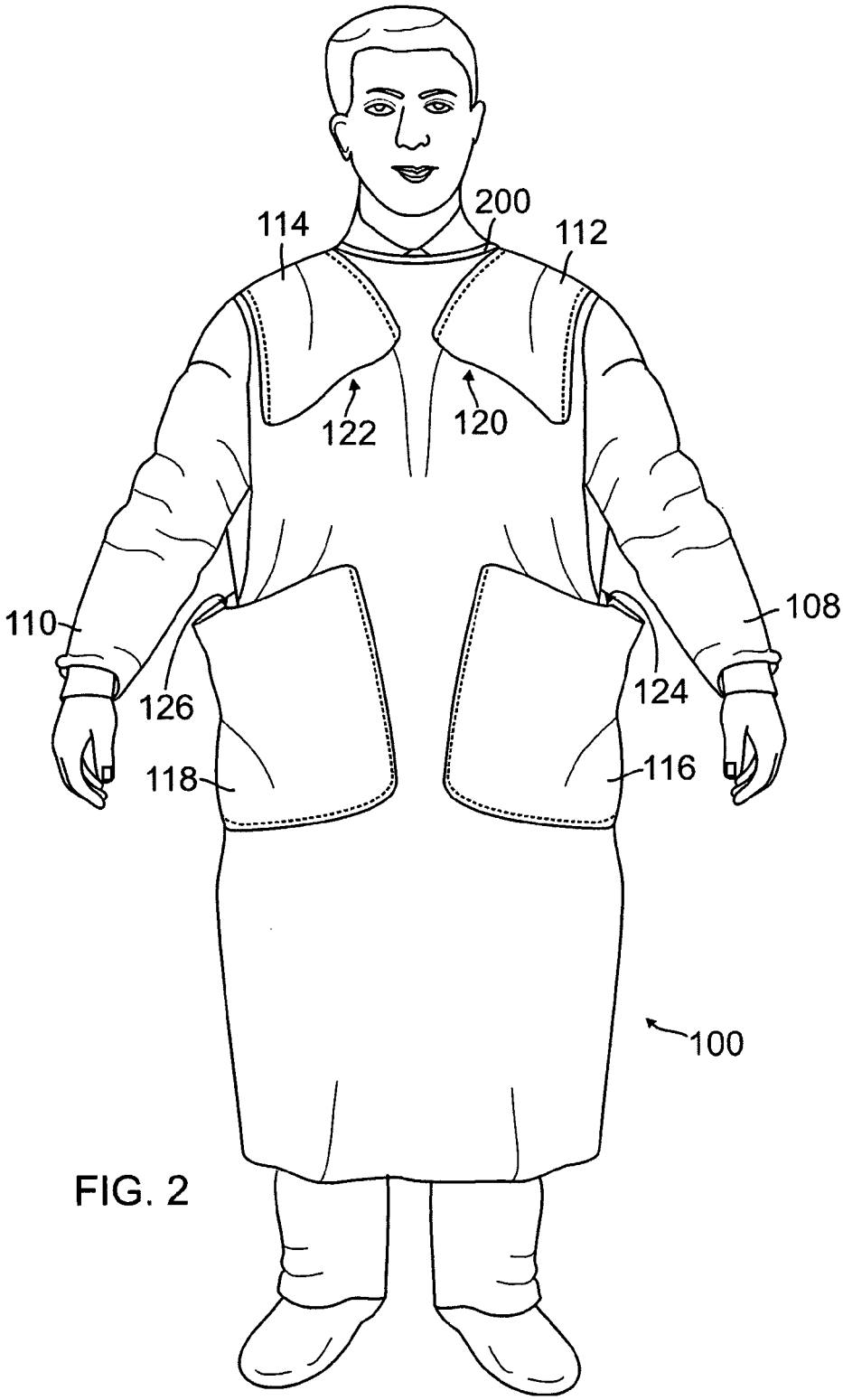
FIG. 2 is a front view of an embodiment of the current invention worn by user.

As shown in FIG. 1, the self-donning surgical gown 100 comprises a front portion 102 continuous with a first back flap 104 and a second back flap 106; a first sleeve 108 between the front portion 102 and the first back flap 104; a second sleeve 110 between the front portion 102 and the second back flap 106; a first shoulder pocket 112 extending from the front portion 102 adjacent to the first sleeve 108 to the first back flap 104 superior to the first sleeve 108; a second shoulder pocket 114 extending from the front portion 102 adjacent to the second sleeve 110 to the second back flap 106 superior to the second sleeve 110; a first waist pocket 116 extending from the front portion 102 to the first back flap 104 inferior to the first sleeve 108; and a second waist pocket 118 extending from the front portion 102 to the second back flap 106 inferior to the second sleeve 110. In other words, the self-donning surgical gown 100 provides a means for moving a covered hand and arm (up to the elbow) beyond the traditional sterile field while maintaining sterility of the covered hand, wherein the means for moving the covered hand beyond the traditional sterile field while maintaining sterility of the covered hand comprises a plurality of sterile pockets 112, 114, 116, 118 each having an opening 120, 122, 124, 126 within the traditional sterile field, wherein the plurality of pockets 112, 114, 116, 118 extend outside the traditional sterile field, whereby inserting the covered hand into the opening 120, 122, 124, or 126 within the traditional sterile field allows the covered hand to traverse outside the traditional sterile field while remaining inside a sterile pocket 112, 114, 116, 118, thereby maintaining sterility of the covered hand and enlarging an effective sterile field.

For convenience and ease of reference, "shoulder pockets" described herein refer to both first and second shoulder pockets, "waist pockets" described herein refer to both first and second waist pockets, "back flaps" described herein refer to both first and second back flaps, "pockets" described herein refer to shoulder pockets, waist pockets, and any other pockets or other types of covering used to enlarge the traditional sterile field, "fasteners" described herein refer to the first and second shoulder fasteners and the first and second waist fasteners. In addition, "covered hands" refer to the fact that health care professionals wear sterile gloves prior to a medical procedure. It is within the scope of the invention to use the self-donning surgical gown without covered hands.

The shoulder pockets 112, 114 each comprise a single shoulder pocket entrance 120, 122 that begins at about the chest area within the traditional sterile field. The remainder of the shoulder pockets 112, 114, however, is completely enclosed and the insides of the shoulder pockets 112, 114 are isolated from the rest of the non-sterile surrounding environment, including the garment worn by the user under the surgical gown 100. The shoulder pockets 112, 114 traverse the upper chest in an upward direction over the shoulders and then down towards the scapula. The shoulder pockets 112, 114 are large enough to receive a hand and a portion of the arm. Thus, a user is able to insert his hands into the shoulder pockets 112, 114 within the traditional sterile field and maneuver his hands outside the traditional sterile area (e.g. above the shoulder and to the back) without contamination of the user's hands and arms by a non-sterile environment, thereby effectively increasing the effective sterile field. With his hands inside the shoulder pockets 112, 114, the user is able to control the top portion of the back flaps 104, 106 with his hands. Therefore, the user is able to maintain absolute sterility of himself an to both the front and back of the surgical gown throughout the self-donning process.

Similarly, the waist pockets 116, 118 comprise a single waist pocket entrance 124, 126 that begins at about the waist level within the traditional sterile field. The remainder of the waist pockets 116, 118, however, is completely enclosed and the insides of the waist pockets 116, 118 are isolated from the rest of the non-sterile surrounding environment, including the garment worn by the user under the surgical gown. The waist pockets 116, 118 extend laterally in opposite directions from each other towards the back flaps 104, 106. The user is able insert his hands into the waist pockets 116, 118 in the traditional sterile field and maneuver his hands laterally towards the back outside the traditional sterile field. Due to the sterile waist pockets 116, 118, however, the hands remain uncontaminated by the non-sterile environment. With his hands inside the waist pockets 116, 118, the user is able to control the mid-portions of the back flaps 104, 106 with his hands. In some embodiments, the waist pocket entrances 124, 126 extend laterally from the front portion 102 in the traditional sterile field toward the back flaps 104, 106 outside the traditional sterile field.

The pockets 112, 114, 116, 118 provide a means for maneuvering the hands and arms from the traditional sterile field to an area traditionally considered outside the sterile field, such as the shoulders and back area. Thus, the pockets 112, 114, 116, 118 may be any type of covering that shields anything inserted into the covering (such as the hands and arms) from the surrounding environment.

The pockets 112, 114, 116, 118 may be formed in many different ways. Non-limiting examples include fastening a second layer of material to the interior side or exterior side of the surgical gown 100 at strategic locations such that an opening or entrance to the pocket is created in the traditional sterile field, fastening prefabricated pouches to the inside or outside of the surgical gown 100, and providing an excess of the surgical gown material within the traditional sterile field that can be inverted, folded or shoved back into the surgical gown 100.

Figure 7:
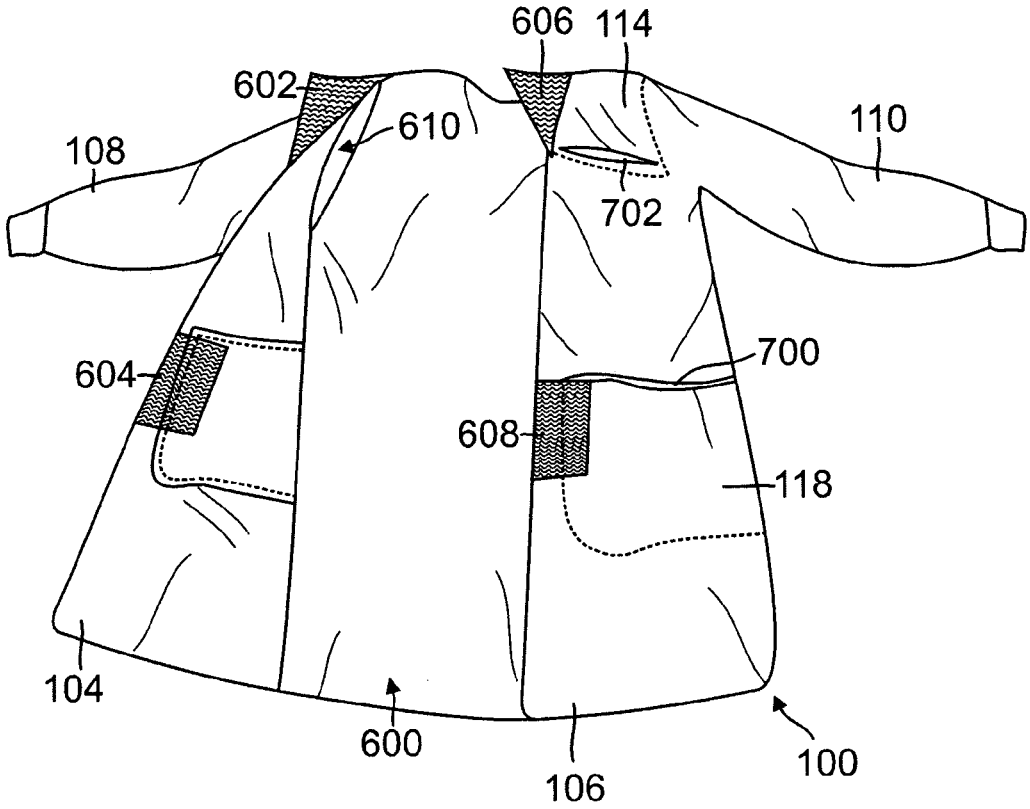
FIG. 7 is a back view of another embodiment of the current invention partially unfolded and partially folded.

In some embodiments, the pockets 112, 114, 116, 118 may be formed by fastening a piece of material either to the exterior 128 or the interior 600 of the gown at the desired location, leaving an entrance portion 120, 122, 124, 126 unfastened to the gown 100. Thus, the pockets 112, 114, 116, 118 may be formed on the exterior side 128 of the front portion 102 of the surgical gown or on the interior side 600. In embodiments, where the pockets 112, 114, 116, 118 are formed on the interior side 600 of the surgical gown 100, the piece of material may be fastened without any openings as shown in FIG. 7. The surgical gown 100, however, would further comprise slits 700, 702 in the gown to function as the shoulder pocket entrances 120, 122 and waist pocket entrances 124, 128 on the surgical gown to access the internal pockets 112, 114, 116, 118. Thus, the surgical gown 100 partially forms the pockets 112, 114, 116, 118.

In some embodiments, the surgical gown 100 may be double layered, in whole or in part, with a single or multiple unfastened portions or slits located in the traditional sterile field to serve as entrance portions for the hands and arms to access in between the two layers of the surgical gown 100.

In other embodiments, the pocket may be a prefabricated pouch, which may be fastened to the surgical gown either on the exterior side 128 or the interior side 600. Thus, a hole or slit may be created in the surgical gown 100 within the traditional sterile field and a pouch may be fastened to the hole to seal the hole and create a pocket. In some embodiments, the prefabricated pouch is attached to the surgical gown 100 at the entrance side of the pouch, leaving the remainder of the pouch detached from the surgical gown, effectively functioning like a glove attached to the gown. In some embodiments, the prefabricated pouch may comprise finger pockets to insert ones fingers to facilitate a glove-like function. In some embodiments, the portion of the pouch adjacent to the gown may have a detachable fastening mechanism to prevent the pouch from flopping around.

In some embodiments, the surgical gown may be made from a single piece of material with an excess of material located in the traditional sterile field. The excess material should be sufficient enough such that it can be pushed back or inverted to the interior side of the surgical gown 100 far enough for the user to reach his shoulders or back.

Figure 3A:
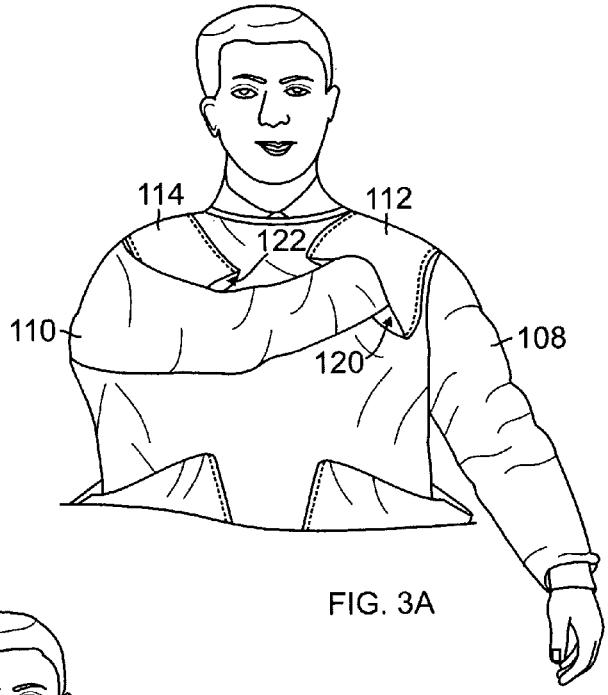
FIG. 3A is a front view of an embodiment of the current invention in use.
Figure 3B:
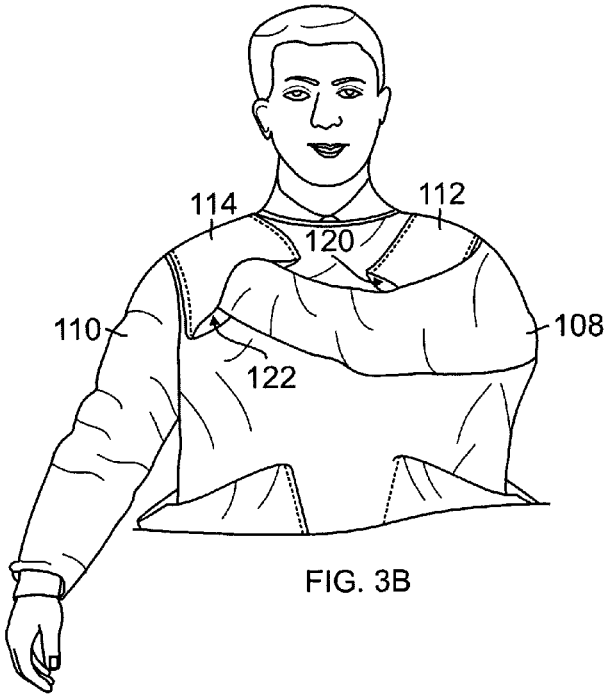
FIG. 3B is a front view of an embodiment of the current invention in use.
Figure 4A:
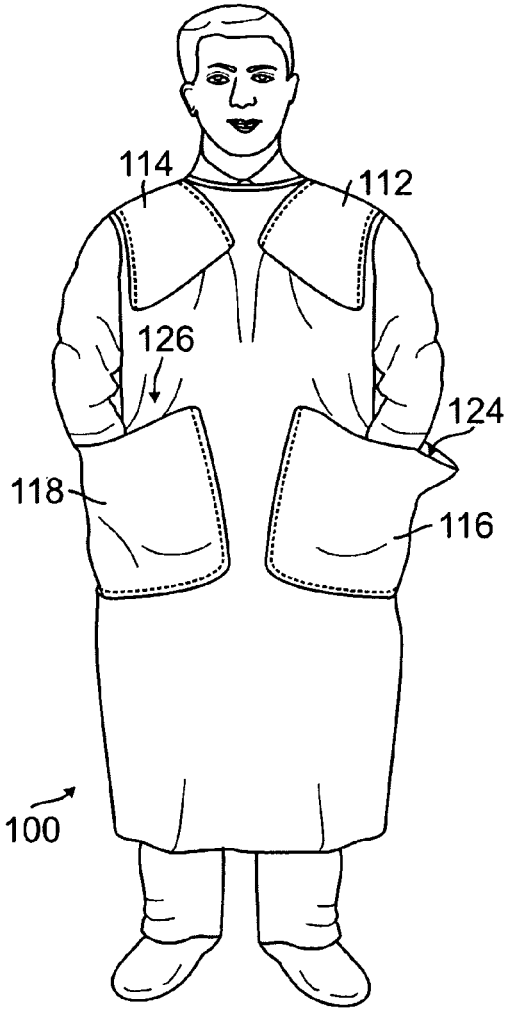
FIG. 4A is a front view of an embodiment of the current invention in use.
Figure 4B:
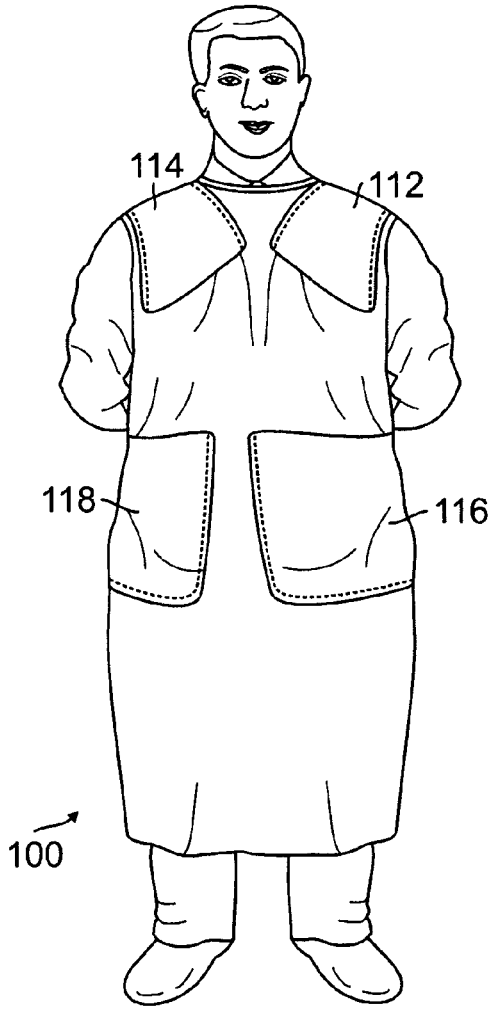
FIG. 4B is a front view of an embodiment of the current invention in use.

One objective is to be able to reach the hands toward the shoulder or the scapula while keeping the rest of the arm close to the body, and within the traditional sterile field, so as not to brush up against areas outside the traditional sterile field, such as the neck, head, face and hair. In some embodiments, the shoulder pocket entrances 120, 122 are aligned at oblique angles to a midline 130 (an imaginary splitting the surgical gown bilaterally into two halves) with the shoulder pocket entrances 120, 122 facing towards the midline, as shown in FIG. 1. This facilitates inserting a first hand into the first shoulder pocket 120 contralateral to the first hand and to facilitate inserting a second hand into the second shoulder pocket 114 contralateral to the second hand as shown in FIGS. 3A and 3B. This provides the most natural motion for reaching towards the shoulder or scapula while keeping the hands and arms close to the body. In other embodiments, the shoulder pocket entrances 120, 122 may be approximately perpendicular to the midline 130 to facilitate inserting the first hand into the second shoulder pocket 114 ipsilateral to the first hand and to facilitate inserting a second hand into the first shoulder pocket 112 ipsilateral to the second hand.

Another objective is to be able to reach the hands toward the mid to lower back areas while keeping the rest of the arm close to the body, and preferably within the traditional sterile field, so as not to brush up against areas outside the traditional sterile field, such as the sides. In some embodiments, the waist pocket entrances 124, 126 may be created approximately perpendicular to the midline 130 and extend from the front portion to the back flaps. This allows the user to insert his hands into the ipsilateral waist pockets 116, 118 at the front portion 102 in the traditional sterile field and slide or maneuver his hands laterally, then towards the back flaps 104, 106 while keeping his hands in the waist pockets 116, 118. Since the insides of each waist pocket are sterile and unexposed to the environment, the hands inside of the waist pockets remain exposed to a sterile environment, thereby effectively increasing the sterile field.

In some embodiments, the waist pocket entrances 124, 126 are localized in the traditional sterile field and formed parallel or at an oblique angles to the midline 130 with the entrance facing toward the midline to facilitate inserting the hand into the waist pocket.

The first back flap 104 comprises a first shoulder fastener 602 and a first waist fastener 604, and the second back flap comprises a second shoulder fastener 606 and a second waist fastener 608. The fasteners 602, 604, 606, 608 releasably adhere to another garment or to itself. A garment is any clothing item including traditional clothing, specialized clothing, scrubs, and the surgical gown itself. Thus, the fasteners 602, 604, 606, 608 may adhere to the undergarments worn by the user or to the surgical gown itself. The fasteners 602, 604, 606, 608 may be any form of quick-attaching and quick-releasing fastening mechanism, such as adhesives, hook-and-loop fasteners, ties, hooks, belts, buckles, buttons, magnets or the like. Adhesives are fasteners that allow two surfaces to adhere together. Adhesives may include glue-like substances, tape-like substances, and the like.

Figure 5:
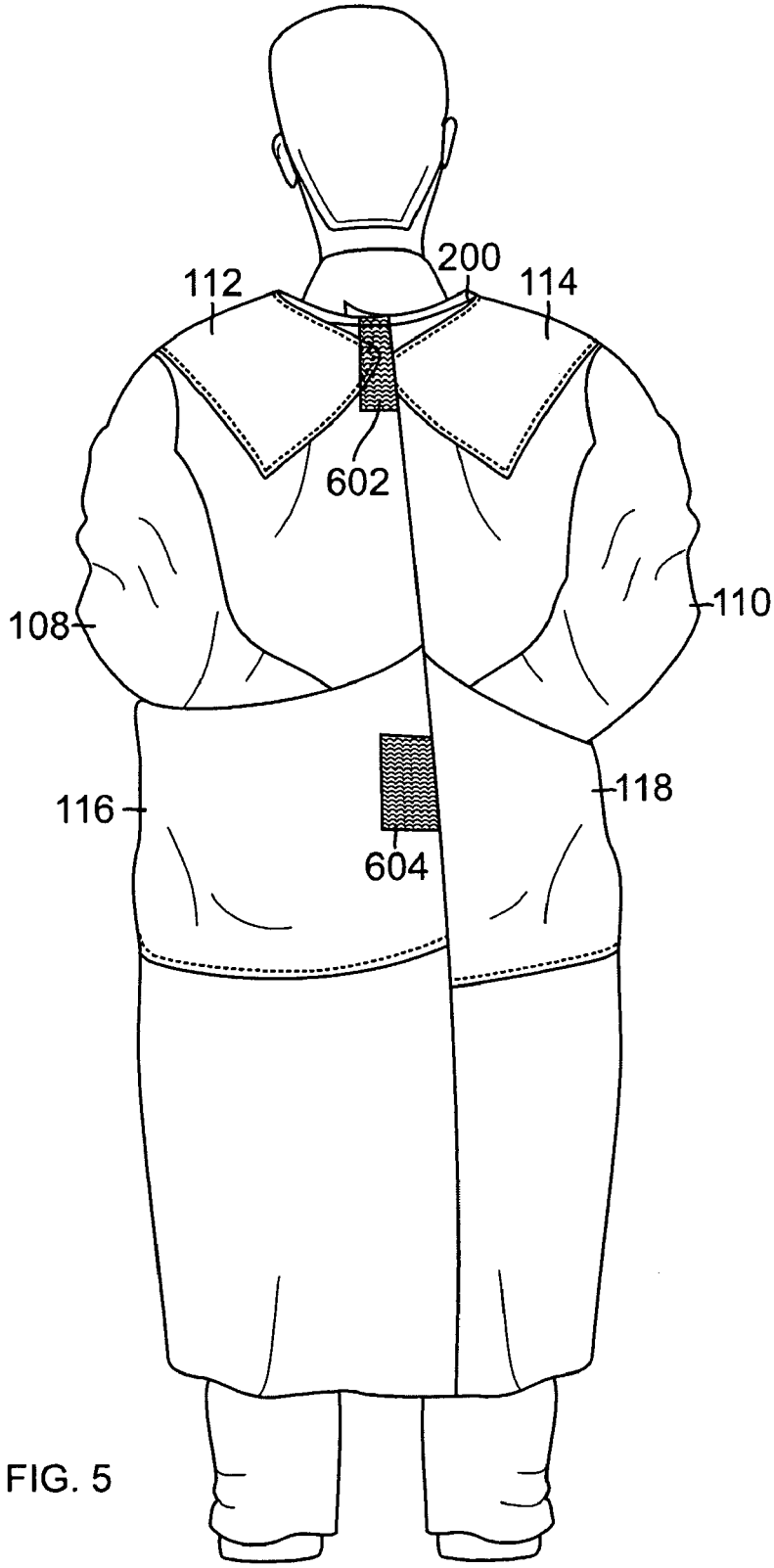
FIG. 5 is a back view of an embodiment of the current invention in use.
Figure 6:
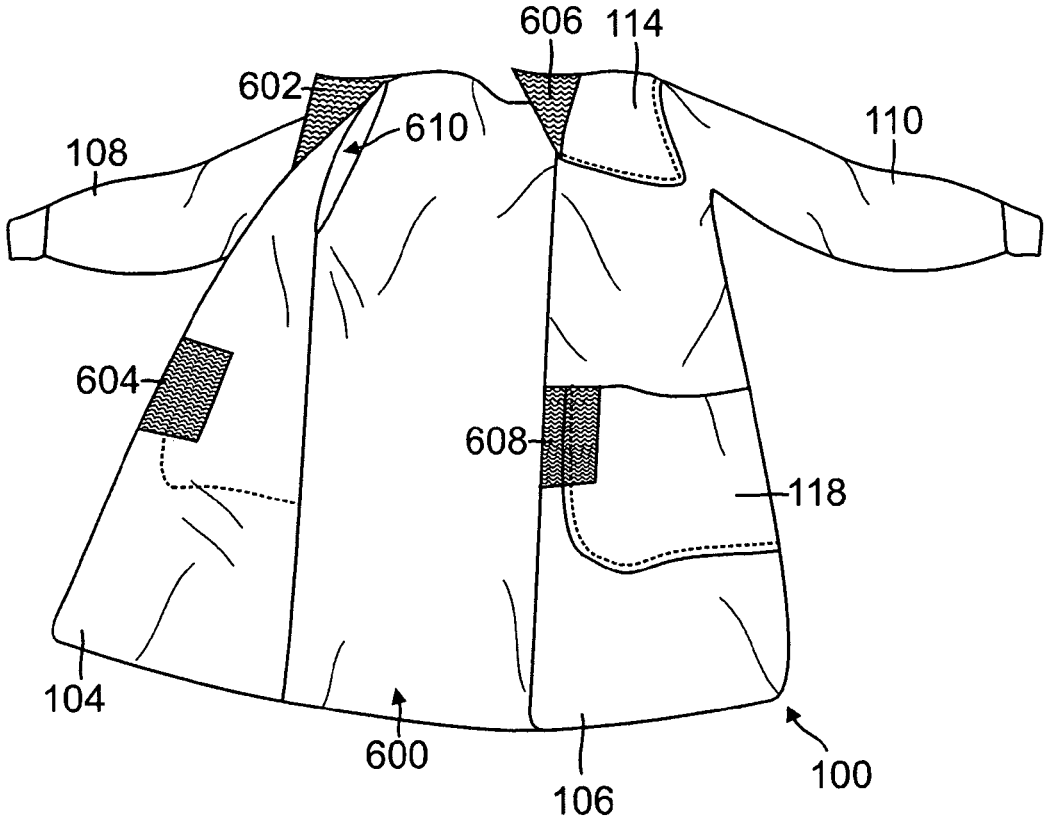
FIG. 6 is a back view of an embodiment of the current invention partially unfolded and partially folded.

As shown in FIGS. 5 and 6, the fasteners 602, 604, 606, 608 are strategically located on the interior 600 and, optionally, the exterior 128, on the surgical gown 100 to be able to secure the surgical gown 100 to the user. The shoulder fasteners 602, 606 may be located on the back flaps 104, 106 on the shoulder portion of the surgical gown 100 or along the neck line 200. In some embodiments, the shoulder fasteners 602, 606 may be located at least partially on the shoulder pockets 112, 114. Having the shoulder fasteners 602, 606 on the shoulder pockets 112, 114 facilitates the proper arrangement of the surgical gown 100. The waist fasteners 604, 608 may be located on the back flaps 104, 106 along the lumbar and/or the thoracic region. In some embodiments, the waist fasteners 604, 608 may be located, at least partially, on the waist pockets 116, 118. In some embodiments, a single fastening strip may extend from the neckline to the lumbar region on the interior and, optionally, the exterior of the surgical gown.

In some embodiments, the fasteners 602, 604, 606, 608 are located on the interior side 600 of the surgical gown 100 and attach to the garment of the user. In other embodiments, portions of the fasteners 602, 604, 606, 608 may be on the interior side of the surgical gown and the reciprocal portions of the fasteners 602, 604, 606, 608 may be on the exterior side 128 of the surgical gown 100 so that the surgical gown 100 is fastened to itself to hang on the user. In other embodiments, the fasteners 602, 604, 606, 608 may extend laterally from the back flaps to connect with each other.

Traditionally, the surgical gown 100 comes sterilized and pre-packaged so that when the package is opened, the entrance to each sleeve 610 (only 1 shown) is exposed to the user. The user places the sterilized gown 100 on a sterilized surface and opens the package. The user may self-don the surgical gown 100 by inserting his hands and arms partially into the pair of arm sleeves 108, 110. Using a first sleeve 108, the user may don a first surgical glove onto a first hand, then using the donned first surgical glove, the user may don a second surgical glove on a second hand. The user may complete the donning of his surgical gown 100 by himself by inserting the first hand into a first shoulder pocket 112 contralateral to the first hand to secure a first shoulder fastener 602 to the user's garment. For example, in embodiments where the fasteners are adhesives or hook-and-loop fasteners the user can adjust the shoulder portion of the surgical gown 100 in place, then firmly press the shoulder portion against his shoulders or back to adhere the surgical gown to his garment. This process may be repeated on the other side by inserting the second hand into a second shoulder pocket 114 contralateral to the second hand to secure a second shoulder fastener 606 to the user's garment or to the surgical gown. Alternatively, for those who are able, the hands may be inserted into the ipsilateral shoulder pockets 112, 114 to secure the garment.

Once the shoulders are secured the user may insert the second hand into a first waist pocket 116 ipsilateral to the second hand at a front portion 102 of the surgical gown 100 and slide the second hand towards a first back flap 104 to secure the first back flap 104 to the user's back. Again, in embodiments where the fasteners are adhesives or hook-and-loop fasteners the user need only press the pocket firmly against his back. This process may be repeated on the other side by inserting the first hand into a second waist pocket 118 ipsilateral to the first hand at the front portion 102 of the surgical gown 100 and sliding the first hand towards a second back flap 106 to secure the second back flap 106 against the user's backside. Alternatively, this process may be done simultaneously and the back flaps 104, 106 secured to each other.

Thus, the user has secured the surgical gown to his own body without exposing his hands and arms to the environment outside the traditional sterile field. In other words, although the hands may have entered outside the traditional sterile field, since the hands were covered by the sterile pockets 112, 114, 116, 118, the hands were not contaminated by the environment outside the traditional sterile field. Therefore, the actual effective sterile field has been enlarged to portions of the upper and lower back.

In addition, the surgical gown 100 may be readjusted while maintaining a sterile field by inserting the user's hands into the first or second shoulder pocket 112, 114 or the first or second waist pocket 116, 118 to detach and re-attach the first and/or second back flap 104, 106 in an adjusted position. The user may also ventilate himself by inserting the user's hands into the first and second waist pockets 116, 118 at the front portion 102, sliding the user's hands towards the first and second back flaps 104, 106, and opening the back flaps 104, 106 to increase an air flow to a backside.

In some embodiments, the self-donning surgical gown may further comprise a fastenable garment to wear under the self-donning surgical gown to provide a reciprocal fastener for the first and second shoulder fasteners 602, 606 and the first and second waist fasteners 604, 606. For example, the fastenable garment may be a specialized vest, shirt, scrub or the like with reciprocal fasteners that reversibly connect to the fasteners 602, 604, 606, 608. For example, the fastenable garment may have an adhesive back so that the fasteners of the surgical gown can adhere to the fastenable garment. In another example utilizing the hook-and-loop fastener, the fasteners 602, 604, 606, 608 may be hooks on the interior side of the surgical gown and the loops may be located on the exterior of the fastenable garment, or vice versa. In another example, the fasteners 602, 604, 606, 608 may be hooks and the fastenable garment may have a plurality of reciprocal hooks, holes, pegs, or the like to hook the fasteners to the fastenable garment. In another example, the fasteners 602, 604, 606, 608 may be magnets and the fastenable garment may have a magnetic back or magnetic back portions. In another embodiment, the fasteners 602, 604, 606, 608 may be snap buttons and the fastenable garment may have a plurality of receivers for the snap buttons. In each case, the reciprocal fasteners on the fastenable garment are strategically positioned along the shoulders, scapula and back so that the surgical gown 100 can fit users of various sizes and so that a single user can adjust the surgical gown 100 to fit loosely, tightly, or any comfort level therebetween.

The self-donning surgical gown 100 may be made from any material known in the art for making surgical gowns, such as cotton, nylon, or a blend of material. In addition, the pockets 112, 114, 116, 118 may also be made of any material known in the art for making surgical gowns, such as cotton, nylon, or a blend of materials. In some embodiments, the self-donning surgical gown is made completely or partially from transparent material. The transparency of the surgical gown allows the user to check his or her pager, cell phone, personal digital assistant, or any other device without the assistance of others and without placing the hands outside the traditional sterile field.

Although this invention has been described in terms of a surgical gown, the features of this invention may be applicable to any field in which a gown, lab coat, or the like, must be donned and a sterile field must be maintained.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention not be limited by this detailed description, but by the claims and the equivalents to the claims appended hereto.

INDUSTRIAL APPLICABILITY

This invention may be industrially applied to the development, manufacture, and use of surgical gowns comprising a plurality of pockets positioned strategically along the shoulders and back to allow the user to insert his hands into the shoulder and waist pockets to attach the surgical gown to his shoulders and back, respectively, without exposing his hands and arms to the environment outside the traditional sterile field, thereby effectively increasing the sterile field and allowing the user to self-don a surgical gown.

What is claimed is:

1. A self-donning surgical gown, comprising:

a. a front portion continuous with a first back flap and a second back flap;

b. a first sleeve between the front portion and the first back flap;

c. a second sleeve between the front portion and the second back flap;

d. a first shoulder pocket extending from the front portion adjacent to the first sleeve to the first back flap superior to the first sleeve;

e. a second shoulder pocket extending from the front portion adjacent to the second sleeve to the second back flap superior to the second sleeve;

f. a first waist pocket extending from the front portion to the first back flap inferior to the first arm sleeve; and g. a second waist pocket extending from the front portion to the second back flap inferior to the second arm sleeve, wherein the self-donning surgical gown has an interior side and an exterior side.

2. The self-donning surgical gown of claim 1, wherein at least one of the first shoulder pocket, the second shoulder pocket, the first waist pocket, or the second waist pocket is formed on the exterior side of the front portion.

3. The self-donning surgical gown of claim 1, wherein at least one of the first shoulder pocket, the second shoulder pocket, the first waist pocket, or the second waist pocket is formed on the interior side of the front portion and wherein the front portion further comprises a plurality of slits to access the at least one pocket.

4. The self-donning surgical gown of claim 1, wherein the first and second shoulder pockets are at an oblique angle to a midline to facilitate inserting a first hand into the first shoulder pocket contralateral to the first hand and to facilitate inserting a second hand into the second shoulder pocket contralateral to the second hand.

5. The self-donning surgical gown of claim 1, wherein the first and second shoulder pockets are perpendicular to the midline to facilitate inserting a first hand into the first shoulder pocket ipsilateral to the first hand and to facilitate inserting a second hand into the second shoulder pocket ipsilateral to the second hand.

6. The self-donning surgical gown of claim 1, wherein the self-donning surgical gown is transparent.

7. The self-donning surgical gown of claim 1, wherein the first back flap comprises a first shoulder fastener and a first waist fastener, and the second back flap comprises a second shoulder fastener and a second waist fastener.

8. The self-donning surgical gown of claim 7, wherein the first and second shoulder fasteners and the first and second waist fasteners are selected from a group consisting of an adhesive, a hook-and-loop fastener, a button, a tie, a magnet, and a hook.

9. The self-donning surgical gown of claim 7, wherein the first and second shoulder fasteners and the first and second waist fasteners are adhesives that releasably adhere to a garment.

10. A self-donning surgical gown, comprising:

a. a front portion continuous with a first back flap and a second back flap, wherein the first back flap comprises a first shoulder fastener and a first waist fastener, and the second back flap comprises a second shoulder fastener and a second waist fastener;

b. a first sleeve between the front portion and the first back flap;

c. a second sleeve between the front portion and the second back flap; and d. a means for moving a covered hand beyond a traditional sterile field while maintaining sterility of the covered hand, wherein the self-donning surgical gown has an interior side and an exterior side.

11. The self-donning surgical gown of claim 10, wherein the means for moving the covered hand beyond the traditional sterile field while maintaining sterility of the covered hand comprises a plurality of pockets each having an opening within the traditional sterile field, wherein the plurality of pockets extend outside the traditional sterile field, whereby inserting the covered hand into the opening within the traditional sterile field allows the covered hand to traverse outside the traditional sterile field while remaining inside the pocket, thereby maintaining sterility of the covered hand and enlarging an effective sterile field.

12. The self-donning surgical gown of claim 11, wherein the plurality of pockets are formed on the interior side of the surgical gown.

13. The self-donning surgical gown of claim 11, wherein the plurality of pockets are formed on the exterior side of the surgical gown.

14. The self-donning surgical gown of claim 11, wherein the surgical gown at least partially comprises a double layer to form the plurality of pockets.

15. The self-donning surgical gown of claim 10, wherein the first and second shoulder fasteners and the first and second waist fasteners are fasteners selected from the group consisting of an adhesive, a hook-and-loop fastener, a button, a tie, a magnet and a hook.

16. The self-donning surgical gown of claim 10 further comprising a fastenable garment to wear under the self-donning surgical gown to provide a reciprocal fastener for the first and second shoulder fasteners and the first and second waist fasteners.

17. The self-donning surgical gown of claim 16, wherein the fastenable garment comprises a plurality of reciprocal fasteners selected from the group consisting of an adhesive, a hook-and-loop fastener, a button, a tie, a magnet and a hook.

18. A method of donning a surgical gown, comprising:

a. inserting a user's hands and arms partially into a pair of arm sleeves;

b. using a first sleeve to don a first surgical glove onto a first hand;

c. using the donned first surgical glove to don a second surgical glove on a second hand;

d. inserting the first hand into a first shoulder pocket contralateral to the first hand to secure a first shoulder fastener;

e. inserting the second hand into a second shoulder pocket contralateral to the second hand to secure a second shoulder fastener;

f. inserting the second hand into a first waist pocket ipsilateral to the second hand at a front portion of the surgical gown and sliding the second hand towards a first back flap to secure the first back flap; and g. inserting the first hand into a second waist pocket ipsilateral to the first hand at the front portion of the surgical gown and sliding the first hand towards a second back flap to secure the second back flap.

19. The method of claim 18, further comprising readjusting the surgical gown while maintaining a sterile field by inserting the user's hands into the first or second shoulder pocket or the first or second waist pocket to detach and re-attach the first and/or second back flap in an adjusted position.

20. The method of claim 18, further comprising ventilating the user by a. inserting the user's hands into the first and second waist pockets at the front portion;

b. sliding the user's hands towards the first and second back flaps; and c. opening the back flaps to increase an air flow to a backside.

* * * * *